United States Patent [19]

Deutsch

[11] Patent Number: 4,679,478

[45] Date of Patent: Jul. 14, 1987

[54] TOUCH RESPONSIVE MUSICAL TONE GENERATOR

[75] Inventor: Ralph Deutsch, Sherman Oaks, Calif.

[73] Assignee: Kawai Musical Instrument Mfg. Co., Ltd., Hamamatsu, Japan

[21] Appl. No.: 816,466

[22] Filed: Jan. 6, 1986

[51] Int. Cl.[4] ..... G10H 1/057; G10H 1/46; G10H 7/00

[52] U.S. Cl. ..... 84/1.1; 84/1.26; 84/1.27

[58] Field of Search ..... 84/1.1, 1.13, 1.26, 84/1.27, DIG. 7

[56] References Cited

U.S. PATENT DOCUMENTS

| | | | |
|---|---|---|---|
| 4,119,006 | 10/1978 | Whitefield | 84/1.13 |
| 4,333,377 | 6/1982 | Niezgoda et al. | 84/1.1 X |
| 4,440,056 | 4/1984 | Kozuki et al. | 84/1.26 |
| 4,444,082 | 4/1984 | Whitefield | 84/1.13 X |
| 4,493,237 | 1/1985 | DeLong et al. | 84/1.26 |
| 4,502,361 | 3/1985 | Viitanen et al. | 84/1.26 |
| 4,520,708 | 6/1985 | Wachi | 84/1.26 |
| 4,535,669 | 8/1985 | Kaneko | 84/1.26 |
| 4,558,624 | 12/1985 | Tomisawa et al. | 84/1.26 |

*Primary Examiner*—Stanley J. Witkowski

*Attorney, Agent, or Firm*—Ralph Deutsch

[57] ABSTRACT

A keyboard operated musical instrument is disclosed in which the musical tones are generated by reading out a sequence of data values stored in memories. A first memory stores the musical waveshape for the attack and decay phases of the musical tone. One of a plurality of memories, each storing a period of a different waveshape, are selected by means of a touch response signal generated by the manner with which a keyswitch is actuated. At the end of the decay phase the waveshape selected by the touch response signal is read out sequentially and repetitively and is substituted for the data stored in the first memory. A means is provided to minimize the transient created in the transition between data read out of the first memory and the selected second memory. Provision is also made for a touch response loudness effect.

23 Claims, 5 Drawing Figures

TOUCH RESPONSIVE MUSICAL TONE GENERATOR

BACKGROUND OF THE INVENTION

1. Field of the Invention

This invention relates to musical tone synthesis and in particular is concerned with an improvement for producing tones whose spectra are touch responsive to the actuation of keyboard switches.

2. Description of the Prior Art

A wide variety of musical tone generation systems have been designed which attempt to realistically replicate the sounds produced by conventional acoustic musical instruments. In general these systems have produced only poor imitative sounds because they lack the capability to produce the complex time variations of the musical waveform that characterize a tone from a particular acoustic musical instrument. The most obvious method to imitate a musical instrument is to record the sound and to replay these recordings in response to an actuated keyswitch.

While at first glance the straightforward technique of recording and keyed playback seems to be attractive, a practical realization of such a musical instrument can be burdened by a large amount of memory for storing the recorded data. The maximum amount of storage is associated with a system that uses a separate and distinct recording for each note played in the range of the musical instrument's keyboard. Some economy in storage has been made by using a single recording for several contiguous notes making use of the assumption that the waveshape for the imitated musical instrument does not change greatly between successive notes.

Electronic musical tone generators that operate by playing back recorded musical waveshapes stored in a binary digital data format have been given the generic name of PCM (Pulse Code Modulation). This is an unfortunate label because PCM can mean almost anything. In particular PCM in no way simply identifies the tone generator as one in which a recorded tone is simply stored in a binary digital data format. A musical instrument of the PCM type is described in U.S. Pat. No. 4,383,462 entitled "Electronic Musical Instrument." In the system described in the patent the complete waveshape of a musical tone is stored for the attack and decay portions of the musical tone. A second memory is used to store the remainder of the tone which comprises the release phase of the musical tone. The sustain phase of the tone is obtained by using a third memory which stores only points for a single period of a waveshape. After the end of the decay phase, the data stored in the third memory is read out repetitively and the output data is multiplied by an envelope function generator to create the amplitude variation for the sustain and release phases of the generated musical tone.

It is an inherent characteristic of most orchestral type musical instruments that the spectral composition of the tone is a function of the loudness with which the instrument is played. If such loudness spectral variations are to be imitated in a simple data storage type PCM tone generation system, the number of waveshape memories would have to be increased. The large amount of memory would make it difficult to implement such a system at a low enough cost to produce a commercially viable instrument.

SUMMARY OF THE INVENTION

In a musical tone generator of the type in which the musical tone is generated by reading out consecutive values of a stored set of data points, a touch responsive tone color is obtained by using one memory for the attack and decay phases and a second memory for the sustain and release phases of the musical waveshape. A plurality of memories are provided for the second memory. Each of these memories stores one period of a waveshape and each such waveshape has a different spectra. One of these memories is selected by the magnitude of the touch response signal which is generated by a touch response detector which monitors the manner in which the keyswitches are actuated.

A smooth transition is made between the data read out of attack waveshape memory and the selected memory by forcing the transition to occur at a zero crossing. An ADSR envelope generator is used to provide the envelope variations corresponding to the sustain and release phases of the generated musical tone.

A subsystem is provided so that the loudness of the generated musical tone can be controlled by the touch response signal.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a musical tone generator of the type in which a portion of a musical waveshape is stored in a memory. The generated tones are varied in spectral content in response to the manner in which the instrument's keyboard switches are actuated.

Figure 5:
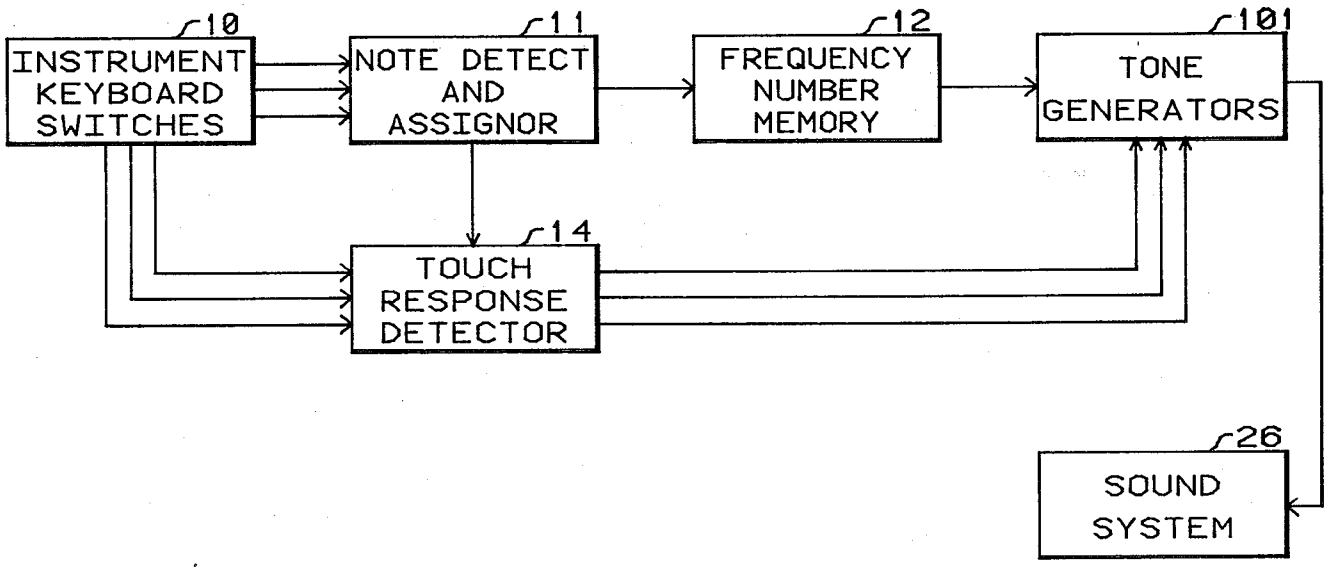
FIG. 5 is a schematic diagram of an embodiment of the invention.

FIG. 5 shows an embodiment of the present invention as incorporated into a keyboard operated electronic musical tone generator. The keyboard switches are contained in the system block labeled instrument keyboard switches 10. If one or more of the keyboard switches has a switch status change and is actuated ("on" switch position), the note detect and assignor 11 encodes a signal which designates the detected keyboard switch having the status change to an actuated state. The encoded detected signals are stored in a memory which is contained in the note detect and assignor 11. A tone generator is assigned to each actuated keyswitch using the encoded detection signals generated by the note detect and assignor 11.

A suitable configuration for a note detect and assignor subsystem is described in U.S. Pat. No. 4,022,098 entitled "Keyboard Switch Detect And Assignor." This patent is hereby incorporated by reference.

When the note detect and assignor 11 finds that a keyboard switch has been actuated, a frequency number corresponding to the actuated switch is read from the frequency number memory 12. The frequency number memory 12 can be implemented as a read-only addressable memory (ROM) containing data words stored in binary numeric format having values $2^{(N-M)/12}$ where N has the range of values N=1, 2, . . . , M and M is equal to the number of keyswitches on the musical instrument's keyboard. The frequency numbers represent the ratios of the frequencies of the generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

Figure 1:
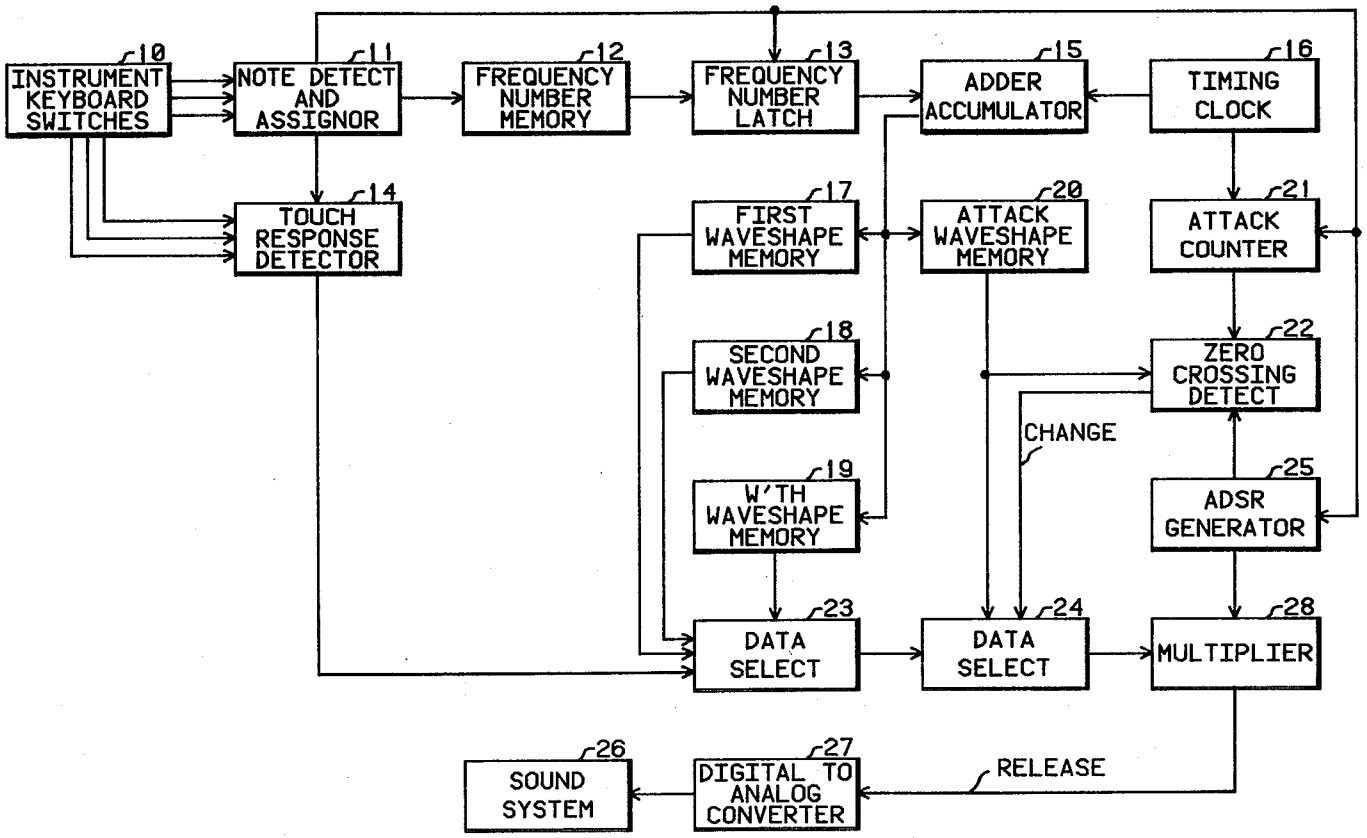
FIG. 1 is a schematic diagram of an embodiment of the invention showing the details of one of the tone generators.

FIG. 1 illustrates an embodiment of the invention showing the details of one of the tone generators contained in the box of FIG. 5 labeled tone generators 101.

The frequency number read out of the frequency number memory 12 is stored in the frequency number latch 13. In response to timing signals produced by the timing clock 16, the frequency number contained in the frequency number latch 13 is successively added to the content of an accumulator contained in the adder-accumulator 15. The content of this accumulator is the accumulated sum of a frequency number.

The attack waveshape memory 20 is a memory which stores the attack and decay phases of a preselected musical tone. The final generated musical tone will have an envelope variation of the standard ADSR curve (Attack/Decay/Sustain/Release). In response to a subset of the most significant bits of the accumulated frequency number in the adder-accumulator 15, stored data words are read out of the attack waveshape memory 20.

A plurality of waveshape memories of number W are used to store a period of a musical waveshape corresponding to the sustain portion of the generated musical tone. This is the steady-state region of the generated musical tone. Each of these stored waveforms has a different harmonic structure that is associated with a given loudness level of the generated musical tone. Three of these waveshape memories are shown explicitly in FIG. 1. These are the first waveshape memory 17, the second waveshape memory 18 and the W'th waveshape memory 19. These symbolically represent the plurality of W waveshape memories.

The touch response detector 14 generates a touch response signal which is a measure of the speed with which a keyswitch is actuated. This can be implemented by measuring the time interval required for the keyswitch to move between two key contacts. A method of implementing the touch response detector in cooperation with the note detect and assignor is described in the copending patent application Ser. No. 677,637 filed Dec. 3, 1984 and now U.S. Pat. 4,620,469 entitled "Key Assignor For A Touch Responsive Electronic Musical Instrument." The referenced invention and the present invention are both assigned to the same assignee.

The touch response signal generated by the touch response detector 14 is used by the data select 23 to select data read out from a corresponding one of the plurality of waveshape memories 17–19. Data is read out from these memories in response to the same subset of the most significant bits of the accumulated frequency number in the adder-accumulator 15 that are used to read out data stored in the attack waveshape memory 20.

The attack counter 21 is initialized to its zero count state by the note detect and assignor 11 at the same time that a tone generator is assigned to an actuated keyboard switch. The same initializing signal is also sent to the ADSR generator 25 thereby initiating the generation of a corresponding ADSR envelope function.

The attack counter 21 is used to count the timing signals generated by the timing clock 16. When the attack counter reaches a prespecified count state an enabling signal is generated and transmitted to the zero crossing detect 22. The prespecified count is determined in advance by the approximate time required to read out the attack and decay musical waveshape that is stored in the attack waveshape memory 20.

Figure 2:
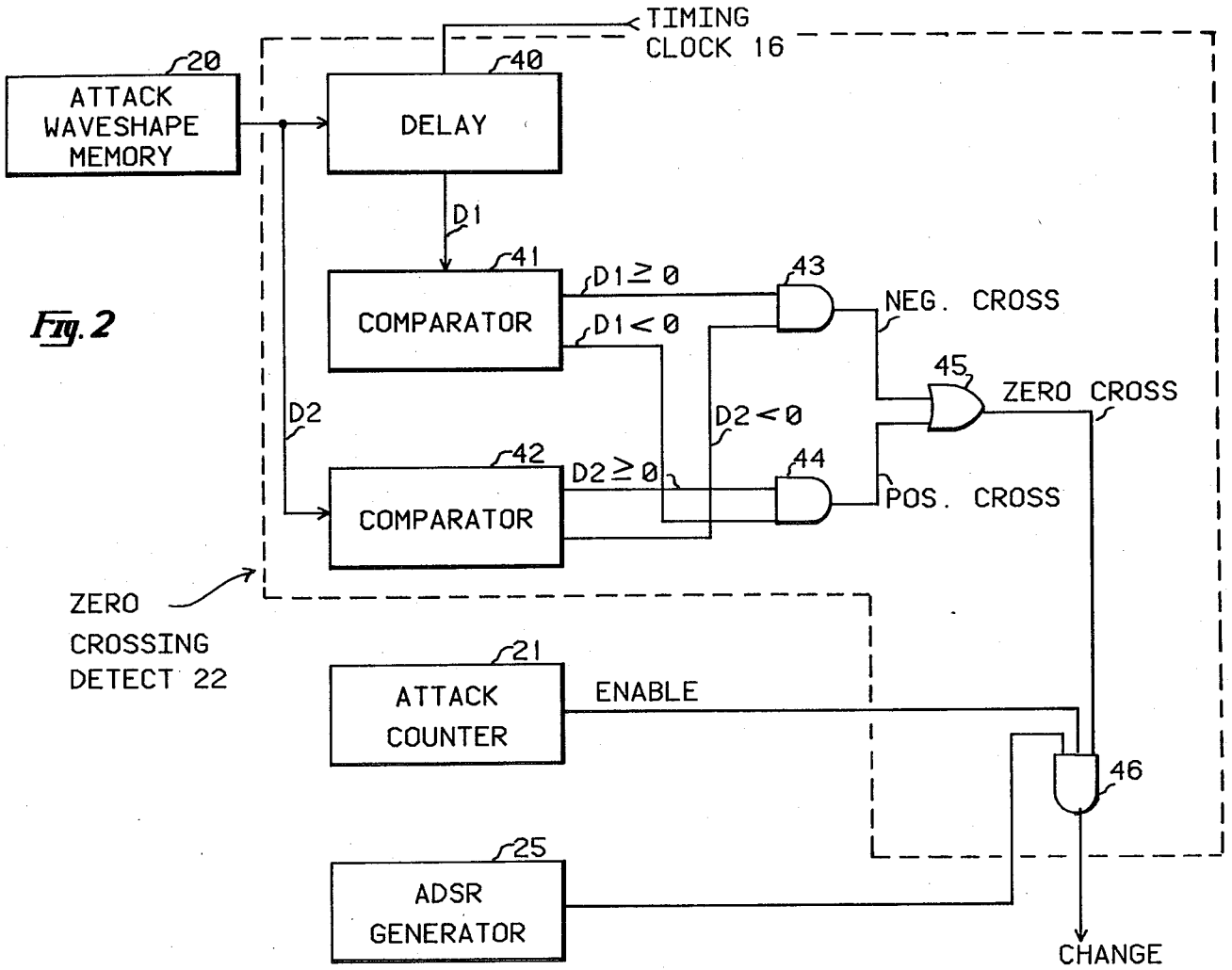
FIG. 2 is a schematic diagram of the zero crossing detect 22.

The detailed logic of the zero crossing detect 22 is shown in FIG. 2. The zero crossing detect 22 will generate a CHANGE signal if the ADSR generator 25 has completed its decay phase, if the attack counter 21 has created its enabling signal, and if a zero crossing has been detected in the sequence of data values which are read out from the attack waveshape memory 20.

When the CHANGE signal is transmitted to the data select 24, the data from the plurality of waveshape memories 17–19 selected by the data select 23 is transmitted to the multiplier 28. If the CHANGE signal has not been generated then the data select transfers the data read out from the attack waveshape memory 20 to the multiplier 28.

The multiplier 28 multiplies the waveshape data furnished by the data select 24 with the tone ADSR envelope function furnished by the ADSR generator 25. A suitable implementation for the ADSR generator 25 is described in U.S. Pat. No. 4,079,650 entitled "ADSR Envelope Generator." This patent is hereby incorporated by reference.

The ADSR generator 25 serves the function of an envelope function generator. The multiplier 28 serves the function of an envelope function means. This multiplier can also be called an envelope multiplier means.

The output data from the multiplier 28 is converted into an analog signal by means of the digital-to-analog converter 27. The resultant signal is transformed into an audible musical tone by means of the sound system 26 which consists of a conventional amplifier and speaker combination.

FIG. 2 shows the system details of the zero crossing detect 22. Each data signal $D_2$ read out from the attack waveshape memory 20 is delayed by one timing signal from the timing clock 16 by means of the delay 40. The delayed signal is denoted by the symbol D1. The comparator 41 sends a "1" binary logic state signal to the AND-gate 43 if $D1 \geqq 0$ and its sends a "1" signal to the AND-gate 44 if $D1 < 0$. The comparator 42 sends a "1" binary logic state signal to the AND-gate 43 if $D2 < 0$ and it sends a "1" signal to AND-gate 44 if $D2 \geqq 0$. Therefore OR-gate 45 will provide an output "1" signal if successive data points read out from the attack waveshape memory 20 correspond to either a positive or negative slope zero crossing of the stored waveshape.

The AND-gate 46 will generate a logic binary state of "1" for the CHANGE signal if a zero crossing has been detected at the output of the OR-gate 45, if the attack counter 23 has created the ENABLE signal and if the ADSR generator 25 has reached its sustain state.

Only a representative one of a plurality of tone generators, contained in the system block labeled tone generators 101 in FIG. 5, is shown in FIG. 1. The representative tone generator is comprised of the system blocks 13,15,17 18,19 20 21,22,23,24,28 and 27. These blocks can be replicated for the other tone generators to provide for a polyphonic musical tone generator.

Figure 3:
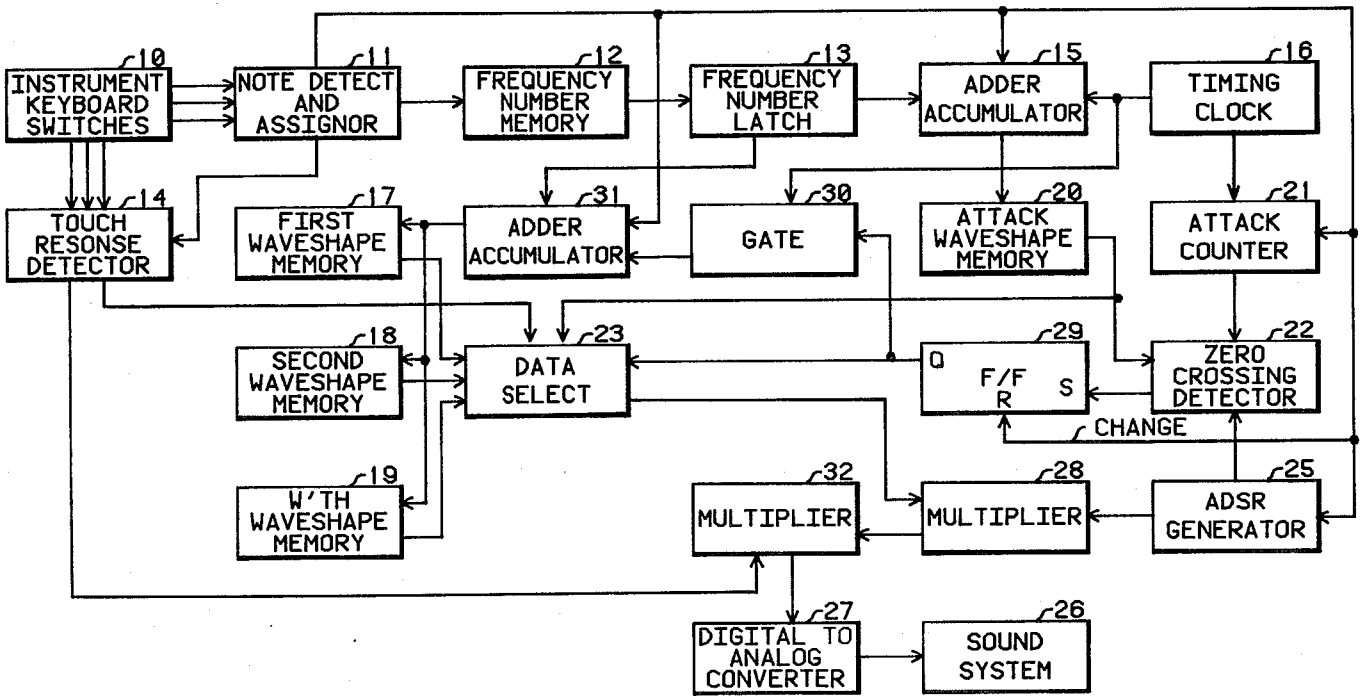
FIG. 3 is a schematic diagram of an alternate embodiment of the invention.

An alternative embodiment of the present invention is shown in FIG. 3. This alternative version provides a means for modifying the loudness of a generated musical tone in response to the touch response signal generated by the touch response detector 14. A second improvement is in the reduction of a possible tone transient at the instant when the output data source is switched from the attack waveshape memory 20 to a selected one of the plurality of waveshape memories 17–19.

The touch response loudness variation is produced by the multiplier 32. This multiplier multiplies the output data produced by the multiplier 28 with the touch response signal created by the touch response detector 14.

The waveshape data points stored in the waveshape memories 17–18 are each selected such that the stored waveshapes always start either from a zero value or a small value at the minimum memory address number.

In response to the initializing signal produced by the note detect and assignor 11, the flip-flop 29 is reset so that its output state is the binary logic state signal Q="0". At the same time the adder-accumulators 15 and 31 are initialized to a zero value, the attack counter 21 is reset to its minimum value, and the ADSR generator 21 is started in its attack phase.

When the CHANGE signal is generated by the zero crossing detector 22 in the manner previously described, the flip-flop 29 is set so that the output state is Q="1". In response to the state Q="1", the gate 30 transfers timing signals from the timing clock 16 to the adder-accumulator 31. When these timing signals are received by the adder-accumulator 31, the frequency number stored in the frequency number latch 13 is successively added in an accumulator to form an accumulated frequency number.

A subset of the most significant bits of the accumulated frequency number contained in the adder-accumulator 31 is used to address waveshape data values from the plurality of waveshape memories 17–19.

In response to the state Q=1 of the flip-flop 29, the data select 23 will inhibit the data addressed out of the attack waveshape memory 20 from reaching the multiplier 28 and instead will transmit the data read out from one of the plurality of waveshape memories 17–19. The particular selected waveshape memory is determined by the magnitude of the touch response signal generated by the touch response detector 14.

In the manner described above the transition from the stored waveform in the attack waveshape memory 20 to a waveform stored in the selected one of the plurality of waveshape memories 17–19 is always made at a zero or very small amplitude value for the old and new waveshapes and thus the tone transient that occurs at the transition moment is minimized so that it is inaudible.

Figure 4:
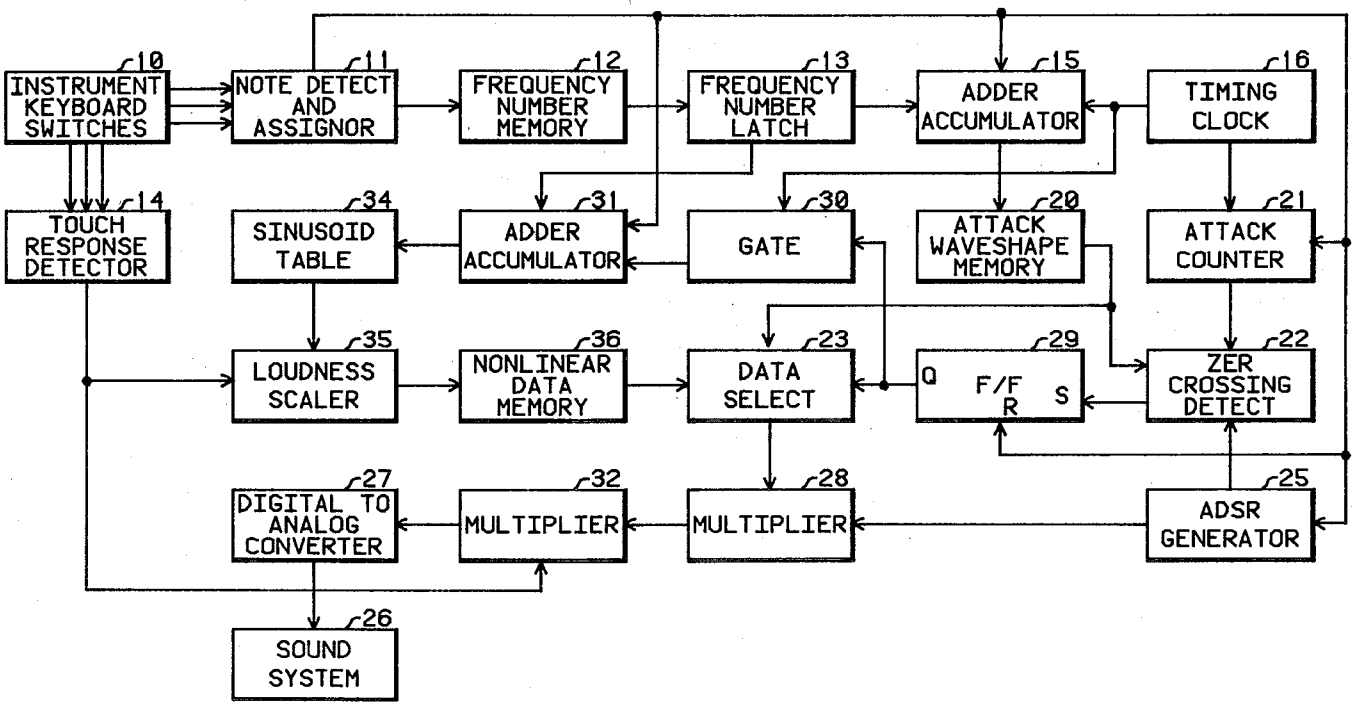
FIG. 4 is a schematic diagram of an embodiment of the invention using nonlinear waveshape distortion.

Another alternative embodiment of the present invention is shown in FIG. 4. The distinguishing feature of this alternative is the elimination of the plurality of waveshape memories 17–19 and the substitution of the sinusoid table 34, loudness scaler 35, and the nonlinear data memory 36.

The adder-accumulator 31 operates in the same manner described previously for the system shown in FIG. 3 to compute an accumulated frequency number when the flip-flop 29 is set so that Q="1".

A subset of the most significant bits of the accumulated frequency number contained in the adder-accumulator 31 is used to read out trigonometric sinusoid function values stored in the sinusoid table 34. The sinusoid table 34 is advantageously implemented as a ROM (Read Only Memory) storing values of the trigonometric function sin $(2\pi\theta/S)$ for $0 \leqq \theta \leqq S$ at intervals of D. D is a table resolution constant. S corresponds to the number of equally spaced data points associated with the period of the steady state portion of the waveshape stored in the attack waveshape memory 20.

The trigonometric sinusoid values read out from the sinusoid table 34 are scaled in magnitude by means of the loudness scaler 35. The loudness scaler 35 is a multiplier which multiplies the trigonometric function values by the touch response signal furnished by the touch response detector 14 to produce a scaled sinusoid function values.

The scaled sinusoid function values are used to read out data stored in the nonlinear data memory 36. The data read out from the nonlinear data memory is furnished as an input to the data select 23. This data will be selected and transmitted to the multiplier 28 if the state of the flip-flop 29 is Q="1". If Q="0", the data select 23 will transmit the data read out of the attack waveshape memory 20 to the multiplier 28.

The data values stored in the nonlinear data memory are selected such that a periodic waveshape having only a few harmonics is generated if the touch response signal has a small magnitude. As the touch response signal increases in magnitude the nonlinear data memory operates in a fashion which increases the number of harmonics in the generated periodic waveshape.

An example of the data stored in the nonlinear data memory 36 is given in U.S. Pat. No. 4,300,434 entitled "Apparatus For Tone Generation With Combined Loudness And Formant Spectral Variation." This patent is hereby incorporated by reference.

I claim:

1. In combination with a keyboard operated musical instrument having an array of keyswitches, apparatus for producing a musical tone having a spectrum which is responsive to the manner in which the keyswitches are actuated comprising;

a keyswitch state detect means wherein a detect signal is generated in response to each actuated keyswitch in said array of keyswitches;

an encoding means for encoding each said detect signal to generate a detect data word which identifies each said actuated keyswitch corresponding to a generated detect signal;

a touch response means whereby a touch response signal is generated in response to the manner in which a keyswitch is actuated;

an assignor means responsive to each said detect data word whereby one of a plurality of tone generators is assigned to generate a musical tone associated with a corresponding keyswitch contained in said array of keyswitches and whereby said touch response signal and said detect data word are furnished to the tone generator assigned to the corresponding keyswitch; and said plurality of tone generators each of which comprises, an attack and decay waveshape memory means for storing sample values of a musical waveshape including the attack and decay phases of said musical waveshape, a plurality of waveshape memory means each storing a plurality of sample values for a period of a musical waveshape having a preselected spectrum, a memory addressing means responsive to said furnished detect data word whereby data values are read out from said attack and decay waveshape memory means and from said plurality of waveshape memory means at a memory address advance rate corresponding to the associated actuated keyswitch in said array of keyswitches, a first data select means responsive to said furnished touch response signal whereby the plurality of sample values read out from a corresponding one of said plurality of waveshape memory means is selected, a transition means whereby a change signal is generated in response to data values read out of said attack and decay waveshape memory means, a second data select means whereby if said change signal is generated said plurality of sample values selected by said first data select means are selected and whereby if said change signal is not generated said data values read out from said attack and decay waveshape memory means are selected, a conversion means for producing a musical tone responsive to the data selected by said second data select means thereby producing a musical tone having a spectrum which is responsive to the manner in which the keyswitch associated with an assigned tone generator is actuated.

2. In a musical instrument according to claim 1 wherein said assignor means comprises;

a frequency number generating means whereby a frequency number is generated in response to each said detect data word.

3. In a musical instrument according to claim 2 wherein said memory addressing means comprises;

an adder-accumulator means, comprising an accumulator for successively adding said generated frequency number to the contents of said accumulator to produce an accumulated frequency number, an address decoder whereby a memory address number is generated in response to said accumulated frequency number, and a reading means responsive to said memory address number whereby data values are read out from said attack and decay waveshape memory means and from said plurality of waveshape memory means.

4. In a musical instrument according to claim 1 wherein said transition means comprises;

a time clock for providing timing signals, an attack counter for counting said timing signals wherein an end signal is generated when the count exceeds a prespecified number and whereby said counter is reset in response to a detect data word, a zero crossing detector wherein a zero cross signal is generated each time the data values read out from said attack and decay waveshape memory means have a zero value or when consecutive values have a different algebraic sign, and a change signal generator responsive to said cross signal wherein said change signal is generated.

5. A musical instrument according to claim 4 wherein said change signal generator comprises;

an envelope function generator for generating a sequence of data points corresponding to the attack, decay, sustain, and release phases of said musical tone and wherein a start sustain signal is generated at the initiation of the sequence of data points corresponding to said sustain phase, and change signal circuitry whereby said change signal is generated in response to both said zero cross signal and said sustain signal.

6. A musical instrument according to claim 5 wherein said conversion means for producing a musical tone comprises;

an envelope multiplier means for multiplying the sequence of data points generated by said envelope function generator by the data selected by said second data select means.

7. In combination with a keyboard operated musical instrument having an array of keyswitches, apparatus for producing a musical tone having a spectrum which is responsive to the manner in which the keyswitches are actuated comprising, a keyswitch state detect means wherein a detect signal is generated in response to each actuated keyswitch in said array of keyswitches, an encoding means for encoding each said detect signal to generate a detect data word which identifies each said actuated keyswitch corresponding to a generated detect signal, a touch response means whereby a touch response signal is generated in response to the manner in which a keyswitch is actuated, an assignor means responsive to each said detect data work whereby one of a plurality of tone generators is assigned to generate a musical tone associated with a corresponding keyswitch contained in said array of keyswitches and whereby said touch response signal and said detect data word are furnished to the tone generator assigned to the corresponding keyswitch, and said plurality of tone generators each one of which comprises, an attack and decay waveshape memory means for storing sample values of a musical waveshape including the attack and decay phases of said musical waveshape, a plurality of waveshape memory means each of which stores a plurality of sample data values, for a period of a musical waveshape having a preselected spectrum, in a sequence of waveshape memory addresses arranged in an order from a lowest memory address to a highest memory address and whereby a minimum value of said musical waveshape is stored in said lowest waveshape memory address, a first memory addressing means responsive to said data detect work whereby data values are read out from said attack and decay waveshape memory means at a memory advance rate corresponding to the associated actuated keyswitch in said array of keyswitches, a transition means whereby a change signal is generated in response to data values read out of said attack and decay waveshape memory means, a second memory addressing means responsive to said data detect word and responsive to said change signal whereby data values are read of said plurality of waveshape memory means at a memory advance rate corresponding to the associated actuated keyswitch in said array of keyswitches, a first data select means responsive to said touch response signal whereby the plurality of sample values read out from a corresponding one of said plurality of waveshape memory means is selected, a second data select means whereby if said change signal is generated said plurality of sample values selected by said first data select means are selected and whereby if said change signal is not generated said data values read out from said attack and decay waveshape memory means are selected, and a conversion means for producing a musical tone responsive to the data values selected by said second select means thereby producing a musical tone having a spectrum which is responsive to the manner in which the keyswitch associated with an assigned tone generator is actuated.

8. In a musical instrument according to claim 7 wherein said conversion means for producing a musical tone comprises;

a touch response multiplier whereby said data values selected by said second data select means are multiplied by said touch response signal thereby producing a musical tone having a loudness level which is responsive to the manner in which said keyswitches are actuated.

9. In a musical instrument according to claim 7 wherein said assignor means comprises;

a frequency number generating means whereby a frequency number is generated in response to each said detect data word.

10. In a musical instrument according to claim 9 wherein said first memory addressing means comprises;

an adder-accumulator means, comprising an accumulator, for successively adding said generated frequency number to the contents of said accumulator to produce an accumulated frequency number, and a reading means responsive to said accumulated frequency number whereby data values are read out from said attack and decay waveshape memory means.

11. In a musical instrument according to claim 7 wherein said transition means comprises;

a time clock for providing timing signals, an attack counter for counting said timing signals wherein an end signal is generated when the count exceeds a prespecified number and whereby said counter is reset in response to a detect data word, a zero crossing detector wherein a zero cross signal is generated each time the data values read out from said attack and decay waveshape memory means have a zero value or when consecutive values have a different algebraic sign, and a change signal generator responsive to said cross signal wherein said change signal is generated.

12. In a musical instrument according to claim 11 wherein said change signal generator comprises;

an envelope function generator for generating a sequence of data points corresponding to the attack, decay, sustain, and release phases of said musical tone and wherein a start sustain signal is generated at the initiation of the sequence of data points corresponding to said sustain phase, and change signal circuitry whereby said change signal is generated in response to both said zero cross signal and said sustain signal.

13. In a musical instrument according to claim 11 wherein said second memory addressing means comprises;

an adder-accumulator means, comprising an accumulator, for successively adding said generated frequency number to the contents of said accumulator in response to said timing signals to produce an accumulated frequency number, a gate means responsive to said change signal means interposed between said time clock and said adder-accumulator means whereby said timing signals are transmitted if said change signal has been generated, and a reading means responsive to said accumulated frequency number whereby data values are read out of said plurality of waveshape memory means at a memory advance rate corresponding to the associated actuated keyswitch in said array of keyswitches.

14. A musical instrument according to claim 7 wherein said conversion means for producing a musical tone comprises;

an envelope multiplier means for multiplying the sequence of data points generated by said envelope function generator by the data selected by said second data select means.

15. In combination with a keyboard operated musical instrument having an array of keyswitches, apparatus for producing a musical tone having a spectrum which is responsive to the manner in which the keyswitches are actuated comprising;

a keyswitch state detect means wherein a detect signal is generated in response to each actuated keyswitch in said array of keyswitches, an encoding means for encoding each said detect signal to generate a detect data word which identifies each said actuated keyswitch corresponding to a generated detect signal, a touch response means whereby a touch response signal is generated in response to the manner in which a keyswitch is operated, an assignor means responsive to each said detect data word whereby one of a plurality of tone generators is assigned to generate a musical tone associated with a corresponding keyswitch contained in said array of keyswitches and whereby said touch response signal and said detect data word are furnished to the tone generator assigned to the corresponding keyswitch, and said plurality of tone generators each one of which comprises, an attack and decay waveshape memory means for storing sample values of a musical waveshape including the attack and decay phases of said musical waveshape, a nonlinear memory means for storing a preselected set of data values, a first memory addressing means responsive to said furnished data detect word whereby data values are read out from said attack and decay waveshape memory means at a memory advance rate corresponding to the associated actuated keyswitch in said array of keyswitches, a transition means whereby a change signal is generated in response to data values read out of said attack and decay waveshape memory means, a second memory addressing means responsive to said data detect word and responsive to said change signal and responsive to said furnished touch response signal whereby data values are read out of said nonlinear memory means, a data select means whereby if said change signal is generated said data values read out of said nonlinear memory means are selected and whereby if said change signal is not generated said data values read out of said attack and decay waveshape memory means are selected, and a conversion means for producing a musical tone responsive to the data values selected by said data select means thereby producing a musical tone having a spectrum which is responsive to the manner in which the keyswitch associated with an assigned tone generator is actuated.

16. In a musical instrument according to claim 15 wherein said conversion means for producing a musical tone comprises;

a touch response multiplier whereby said data values selected by said data select means is multiplied by said touch response signal thereby producing a musical tone having a loudness level which is responsive to the manner in which said keyswitches are actuated.

17. In a musical instrument according to claim 15 wherein said assignor means comprises;

a frequency number generating means whereby a frequency number is generated in response to each said detect data word.

18. In a musical instrument according to claim 17 wherein said first memory addressing means comprises;

an adder-accumulator means, comprising an accumulator, for successively adding said generated frequency number to the contents of said accumulator to produce an accumulated frequency number, and a reading means responsive to said accumulated frequency number whereby data values are read out from said attack and decay waveshape memory means.

19. In a musical instrument according to claim 15 wherein said transition means comprises;

a time clock for providing timing signals, an attack counter for counting said timing signals wherein an end signal is generated when the count exceeds a prespecified number and whereby said counter is reset in response to a detect data word, a zero crossing detector wherein a zero cross signal is generated each time the data values read out from said attack and decay waveshape memory means have a zero value or when consecutive values have a different algebraic sign, and a change signal generator responsive to said cross signal wherein said change signal is generated.

20. In a musical instrument according to claim 19 wherein said change signal generator comprises;

an envelope function generator for generating a sequence of data points corresponding to the attack, decay, sustain and release phases of said musical tone and wherein a start sustain signal is generated at the initiation of the sequence of data points corresponding to said sustain phase, and change signal circuitry whereby said change signal is generated in response to both said zero cross signal and said sustain signal.

21. In a musical instrument according to claim 19 wherein second memory addressing means comprises;

an adder-accumulator means, comprising an accumulator, for successively adding said generated frequency number to the contents of said accumulator in response to said timing signals to produce an accumulated frequency number, a gate means responsive to said change signal interposed between said time clock and said adder-accumulator means whereby said timing signals are transmitted if said change signal has been generated, and a reading means responsive to said accumulated frequency number whereby data values are read out of said nonlinear memory means at a rate corresponding to the associated actuated keyswitch in said array of keyswitches.

22. In a musical instrument according to claim 21 wherein said reading means comprises;

a sinusoid table for storing values of trigonometric sinusoid function values, a sinusoid table memory addressing means responsive to said accumulated frequency number for reading trigonometric sinusoid function values from said sinusoid table, a scaling means whereby the trigonometric values read out from said sinusoid table are multiplied by said touch response signal to produce scaled trigonometric function values, and a nonlinear memory addressing means responsive for reading out data values from said nonlinear memory means in response to said scaled trigonometric function values.

23. A musical instrument according to claim 15 wherein said conversion means for producing a musical tone comprises;

an envelope multiplier means for multiplying the sequence of data points generated by said envelope function generator by the data selected by said second data select means.

* * * * *